US007791431B2

(12) United States Patent
Han et al.

(10) Patent No.: US 7,791,431 B2
(45) Date of Patent: Sep. 7, 2010

(54) 3-PORT ORTHOGONAL MODE TRANSDUCER AND RECEIVER AND RECEIVING METHOD USING THE SAME

(75) Inventors: Sung Min Han, Daejon (KR); Ho Kyom Kim, Daejon (KR); Joon Gyu Ryu, Daejon (KR); Young Wan Kim, Daejon (KR); Ki Seop Han, Seoul (KR)

(73) Assignee: Electronics and Telecommunications Research Institute, Daejon (KR)

( * ) Notice: Subject to any disclaimer, the term of this patent is extended or adjusted under 35 U.S.C. 154(b) by 276 days.

(21) Appl. No.: 11/948,079

(22) Filed: Nov. 30, 2007

(65) Prior Publication Data

US 2008/0129423 A1 Jun. 5, 2008

(30) Foreign Application Priority Data

Dec. 4, 2006 (KR) ..... 10-2006-0121372
Feb. 27, 2007 (KR) ..... 10-2007-0019616

(51) Int. Cl.
*H01P 1/161* (2006.01)
*H01P 5/12* (2006.01)

(52) U.S. Cl. ..... 333/137; 333/21 A; 333/21 R; 333/122; 333/135

(58) Field of Classification Search ..... 333/117, 333/121, 122, 125, 135, 137, 21 A, 21 R
See application file for complete search history.

(56) References Cited

U.S. PATENT DOCUMENTS 4,366,453 A * 12/1982 Schwarz ..... 333/117
4,504,805 A 3/1985 Ekelman, Jr. et al.
6,031,434 A 2/2000 Tatomir et al.
6,087,908 A 7/2000 Haller et al.
6,621,375 B2 9/2003 Vezmar et al.
2003/0076193 A1 4/2003 Chen et al.

FOREIGN PATENT DOCUMENTS

JP 02189035 A * 7/1990
KR 1020010018682 3/2001

OTHER PUBLICATIONS

Notice of Allowance of Sep. 5, 2008—001391435 dated Jan. 11, 2008.

* cited by examiner

*Primary Examiner*—Robert Pascal
*Assistant Examiner*—Kimberly E Glenn
(74) *Attorney, Agent, or Firm*—Kile Goekjian Reed & McManus PLLC

(57) ABSTRACT

Provided are a 3-port orthogonal mode transducer, and a receiver and receiving method using the same. The 3-port orthogonal mode transducer includes: a transmission port having a rectangular shape elongated in a horizontal direction and configured to transmit a Ka-band (30 GHz) vertical polarization signal; a first reception port having a rectangular shape inclined at about +45 degrees at a location being at about +45 degrees with respect to the transmission port and configured to receive a K-band (20 GHz) vertical or horizontal polarization signal phased-delayed about +45 degrees; and a second reception port having a rectangular shape inclined at about −45 degrees at a location being at about −45 degrees with respect to the transmission port and configured to receive a K-band (20 GHz) vertical or horizontal polarization signal phase-delayed about −45 degrees.

8 Claims, 5 Drawing Sheets

3-PORT ORTHOGONAL MODE TRANSDUCER AND RECEIVER AND RECEIVING METHOD USING THE SAME

CROSS-REFERENCE(S) TO RELATED APPLICATIONS

The present invention claims priority of Korean Patent Application Nos. 10-2006-0121372 and 10-2007-0019616, filed on Dec. 4, 2006 and Feb. 27, 2007, respectively, which are incorporated herein by reference.

BACKGROUND OF THE INVENTION

1. Field of the Invention

The present invention relates to a 3-port orthogonal mode transducer, and a receiver and receiving method using the same; and, more particularly, to a 3-port orthogonal mode transducer, and a receiver and a receiving method using the same for receiving a K-band (20 GHz) vertical or horizontal signal transmitted from a satellite as ±45 degree signals through the 3 port orthogonal mode transducer, searching an optimal location by rotating the 3-port orthogonal mode transducer to make the received two signals have the same intensity, and synthesizing the received two signals to output a synthesized signal, so that an optimal satellite signal is received at an optimal location.

This work was supported by the IT R&D program for MIC/IITA [2005-S-301-02, "Development of Satellite Communications System for Communications, Ocean and Meteorological Satellite"].

2. Description of Related Art

In general, a two-way satellite communications system using linear polarization or circular polarization uses different polarizations in transmission and reception.

Thus, a general orthogonal mode transducer (OMT) used for the two-way satellite communications system is a 2-port orthogonal mode transducer in which a transmission port and a reception port are orthogonal to each other.

In the case where a 3-port orthogonal mode transducer is used, a transmission port and a first Rx (Tx1) port receive co-polarization (co-pol), and the transmission port and a second Rx (Rx2) port receive cross-polarization (cross-pol). Since the Rx1 port or the Rx2 port receives a signal from the satellite, a search for which port receives a main beam must be conducted.

A conventional orthogonal mode transducer will now be described in more detail with reference to FIGS. 1A and 1B.

FIG. 1A illustrates a 2-port orthogonal mode transducer including a rectangular transmission port and a rectangular reception port disposed vertically with respect to the transmission port.

FIG. 1B illustrates a conventional 3-port orthogonal mode transducer including a rectangular first Tx (Tx1) port, and a first Rx (Rx1) port and a second Rx (Rx2) port having rectangular shapes and placed vertically and horizontally with respect to the Tx1 port, respectively.

As mentioned above, in the conventional 3-port orthogonal mode transducer, the transmission port and the Rx1 port receive co-polarization, and the transmission port and the Rx2 port receive cross-polarization. Also, the 3-port orthogonal mode transducer receives a signal from a satellite via the Rx1 port and the Rx2 port.

Thus, when a satellite signal is received, it is difficult for the conventional 3-port orthogonal mode transducer to detect an accurate polarization angle for matching between the two reception ports. Particularly, if an Rx signal is weak, a maximum-search method or a minimum-search method for signal reception fails to trace an accurate polarization angle because of error generation.

Also, the conventional 3-port orthogonal mode transducer receives a satellite signal via one reception port in receiving the satellite signal, thereby failing to receive an optimal satellite signal.

SUMMARY OF THE INVENTION

An embodiment of the present invention is directed to providing a 3-port orthogonal mode, which includes a rectangular transmission port, a first reception port having a rectangular shapes inclined at about +45 degrees at a location being at +45 degrees with respect to the transmission port, and a second transmission port having a rectangular shape inclined at about −45 degrees at a location being at about −45 degrees with respect to the transmission portion to receive K-band (20 GHz) vertical or horizontal polarization signals phase-delayed about ±45 degrees.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

Another embodiment of the present invention is directed to providing a receiver and a receiving method using a 3-port orthogonal mode transducer for receiving a K-band (20 GHz) vertical or horizontal polarization signal transmitted from a satellite as two ±45 degree signals through the 3-port orthogonal mode transducer, searching an optimal location by rotating the 3-port orthogonal mode transducer such that the intensities of the two received signals become the same, synthesizing the two received signal to output a synthesized signal, so that an optimal satellite signal can be received at an optimal location.

In accordance with an aspect of the present invention, there is provided a 3-port orthogonal mode transducer for transmitting a vertical polarization signal, including: a transmission port having a rectangular shape elongated in a horizontal direction and configured to transmit a Ka-band (30 GHz) vertical polarization signal; a first reception port having a rectangular shape inclined at about +45 degrees at a location being at about +45 degrees with respect to the transmission port and configured to receive a K-band (20 GHz) vertical or horizontal polarization signal phased-delayed about +45 degrees; and a second reception port having a rectangular shape inclined at about −45 degrees at a location being at about −45 degrees with respect to the transmission port and configured to receive a K-band (20 GHz) vertical or horizontal polarization signal phase-delayed about −45 degrees.

In accordance with another aspect of the present invention, there is provided a 3-port orthogonal mode transducer for transmitting a horizontal polarization signal, including: a transmission port having a rectangular shape elongated in a vertical direction and configured to transmit a Ka-band (30 GHz) vertical polarization signal; a first reception port having a rectangular shape inclined at about +45 degrees at a location being at about +45 degrees with respect to the transmission port and configured to receive a K-band (20 GHz) vertical or horizontal polarization signal phased-delayed about +45 degrees; and a second reception port having a rectangular shape inclined at about −45 degrees at a location being at about −45 degrees with respect to the transmission port and configured to receive a K-band (20 GHz) vertical or horizontal polarization signal phase-delayed about −45 degrees.

In accordance with another aspect of the present invention, there is provided a vertical or horizontal polarization receiving method using a 3-port orthogonal mode transducer, including the steps of: receiving a K-band (20 GHz) vertical or horizontal signal transmitted from a satellite as two ±45 degree signals by using the 3-port orthogonal mode transducer; and synthesizing the received +45 degree vertical or horizontal polarization signal and the received −45 degree vertical or horizontal polarization signal to output a final vertical or horizontal polarization signal.

DESCRIPTION OF SPECIFIC EMBODIMENTS

The advantages, features and aspects of the invention will become apparent from the following description of the embodiments with reference to the accompanying drawings, which is set forth hereinafter. Therefore, those skilled in the field of this art of the present invention can embody the technological concept and scope of the invention easily. In addition, if it is considered that detailed description on the related art may obscure the points of the present invention, the detailed description will not be provided herein. The preferred embodiments of the present invention will be described in detail hereinafter with reference to the attached drawings.

Figure 1A:
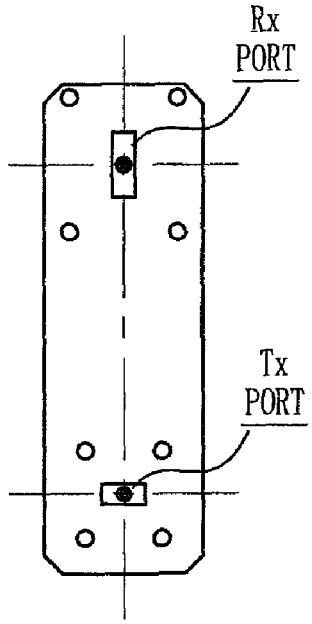
FIG. 1A (PRIOR ART)
FIGS. 1A and 1B are plan views of conventional 3-port orthogonal mode transducers, respectively.
Figure 1B:
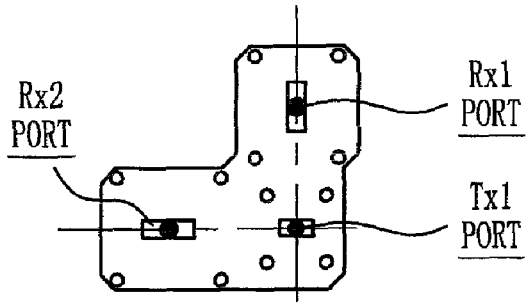
FIG. 1B (PRIOR ART)
Figure 2A:
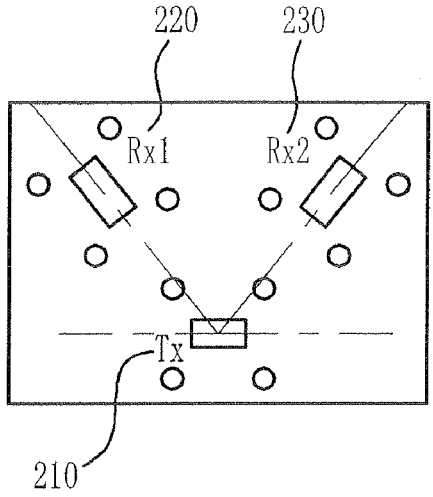
FIGS. 2A and 2B are plan views of respective 3-port orthogonal mode transducers in accordance with an embodiment of the present invention.
Figure 2B:
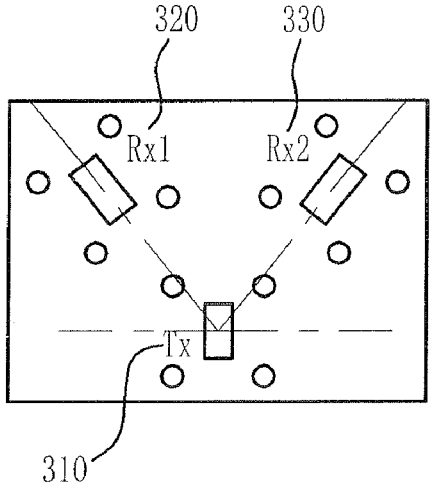

FIGS. 2A and 2B are plan views of 3-port orthogonal mode transducers in accordance with an embodiment of the present invention.

FIG. 2A illustrates a 3-port orthogonal mode transducer for transmission of a vertical polarization signal, and FIG. 2B illustrates a 3-port orthogonal mode transducer for transmission of a horizontal polarization signal.

Figure 3A:
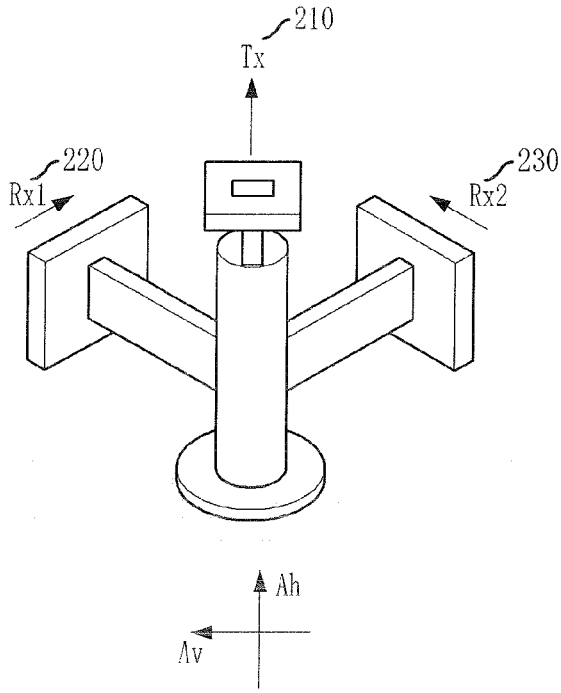
FIGS. 3A and 3B respectively illustrate implementation examples of 3-port orthogonal mode transducers in accordance with an embodiment of the present invention.
Figure 3B:
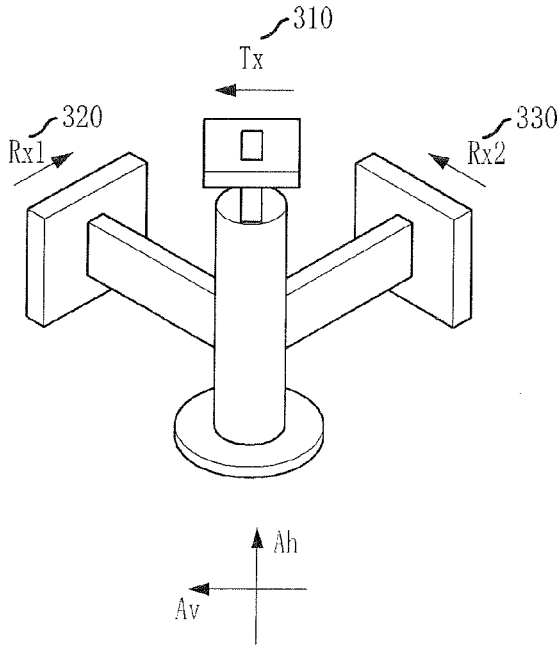

In detail, the 3-port orthogonal mode transducer of transmission of a vertical polarization signal illustrated in FIG. 3 includes a transmission port 210, a first Rx (Rx1) port 220, and a second Rx (Rx2) port 230. The transmission port has a rectangular shape elongated in a horizontal direction and transmits a Ka-band (30 GHz) vertical polarization signal. The Rx1 port 220 has a rectangular shape inclined at about +45 degrees at a location being at about +45 degrees with respect to the transmission port 210, and receives a K-band (20 GHz) vertical or horizontal polarization signal phase-delayed about +45 degrees. The Rx2 port 230 has a rectangular shape inclined at about −45 degrees at a location being at about −45 degrees with respect to the transmission port 21, and receives a K-band (20 GHz) vertical or a horizontal polarization signal phase-delayed about −45 degrees.

An implementation example of the 3-port orthogonal mode transducer for transmission of a vertical polarization signal is illustrated in FIG. 3A.

The 3-port orthogonal mode transducer for transmission of a horizontal polarization signal illustrated in FIG. 2B includes a transmission port 310, an Rx1 port 320, and an Rx2 port 330. The transmission port 310 has a rectangular shape elongated in a vertical direction, and transmits a Ka-band (30 GHz) horizontal polarization signal. The Rx1 port 320 has a rectangular shape inclined at about +45 degrees at a location being at about +45 degrees with respect to the transmission port 310, and receives a K-band (20 GHz) vertical or horizontal polarization signal phase-delayed about +45 degrees. The Rx2 port 330 has a rectangular shape inclined at about −45 degrees at a location being at about −45 degrees with respect to the transmission port 310, and receives a K-band (20 GHz) vertical or horizontal polarization signal phase-delayed about −45 degrees.

An implementation example of the 3-port orthogonal mode transducer for transmission of a horizontal polarization signal is illustrated in FIG. 3.

Figure 4:
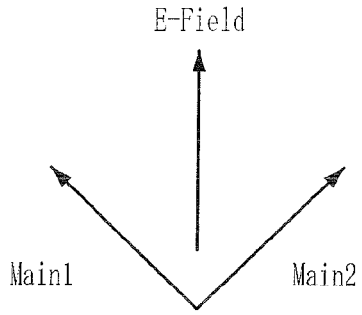
FIG. 4 illustrates one example of ±45 degree vertical or horizontal polarization signals received in a 3-port orthogonal mode transducer in accordance with an embodiment of the present invention.

As shown in FIG. 4, the 3-port orthogonal mode in accordance with an embodiment of the present invention receives a K-band vertical or horizontal signal from a satellite as two main signals (Main1 and Main2) of ±45 degrees.

Figure 5:
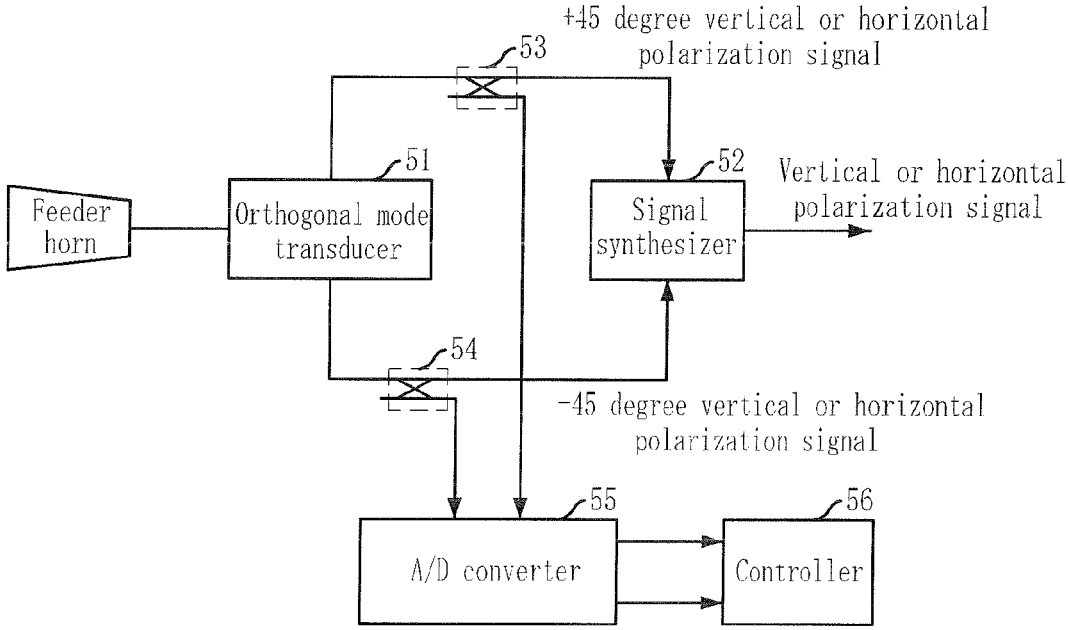
FIG. 5 is a block diagram of a vertical or horizontal polarization receiver using a 3-port orthogonal mode transducer in accordance with an embodiment of the present invention.

FIG. 5 is a block diagram of a vertical or horizontal polarization receiver using a 3-port orthogonal mode transducer in accordance with an embodiment of the present invention.

Referring to FIG. 5, the vertical or horizontal polarization receiver using a 3-port orthogonal mode transducer in accordance with an embodiment of the present invention includes a 3-port orthogonal mode transducer 51, and a signal synthesizer 52. The 3-port orthogonal mode transducer 51 receives a K-band (20 GHz) vertical or horizontal polarization signal from a satellite as two ±45 degree signals. The signal synthesizer 52 synthesizes the +45 degree vertical or horizontal polarization signal and the −45 degree vertical or horizontal polarization signal received from the 3-port orthogonal mode transducer 51, and outputs a final vertical or horizontal polarization signal.

To install the 3-port orthogonal mode transducer 51 at an optimal location, the vertical or horizontal polarization receiver using a 3-port orthogonal mode transducer in accordance with an embodiment of the present invention further includes a first coupler 53, a second coupler 54, an analog/digital (AD) converter 55, and a controller 56. The first coupler 53 branches the +45 degree vertical or horizontal polarization signal received in the 3-port orthogonal mode transducer 51. The second coupler 54 branches the −45 degree vertical or horizontal, polarization signal received in the 3-port orthogonal mode transducer 51. The A/D converter 55 converts analog vertical or horizontal polarization signals branched by the first coupler 53 and the second coupler 54 into digital vertical or horizontal polarization signals. The controller 56 compares intensities of the two signals converted in the A/D converter 55, and outputs rotation information of the 3-port orthogonal mode transducer according to a comparison result.

The rotation information is used to compensate a polarization angle between vertical or horizontal signals received from a satellite via an Rx1 port and an Rx2 port of the 3-port orthogonal mode transducer 51. For example, if the intensity of a signal received via the Rx1 port is greater than the intensity of a signal received via the Rx2 port, the 3-port orthogonal mode transducer 51 is rotated clockwise, and if not, the 3-port orthogonal mode transducer 51 is rotated counterclockwise. In this case, the rotation information means a rotation angle according to the intensities of the two signals.

Also, the 3-port orthogonal mode transducer 51 includes an Rx1 port having a rectangular shape inclined at about +45 degrees at a location being at about +45 degrees with respect to a rectangular transmission port, and an Rx2 port having a rectangular shape inclined at about −45 degrees at a location being at about −45 degrees with respect to the transmission port, so as to receive K-band (20 GHz) vertical or horizontal polarization signals phase-delayed about ±45 degrees.

Also, each of the first coupler 53 and the second coupler 54 branches a signal to 20 dB to 40 dB.

The controller 56 may drive a driver (not shown), according to the rotation information associated with the comparison result of the two signals to rotate the 3-port orthogonal mode transducer 51. The driver rotates the 3-port orthogonal mode transducer 51 about a polarization axis to install the 3-port orthogonal mode transducer 51 to an optimal location.

Figure 6:
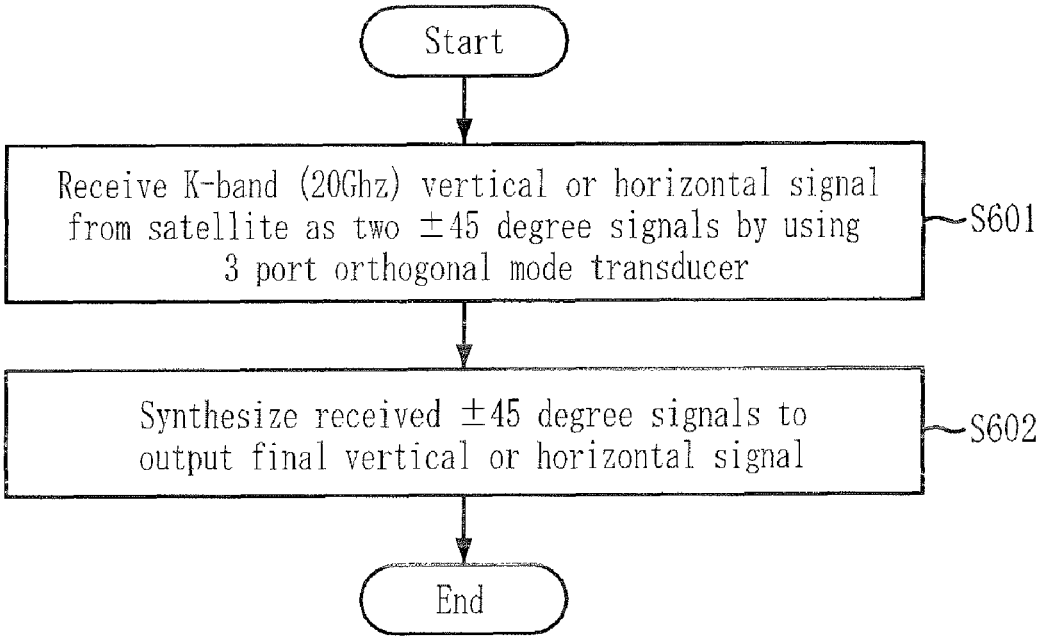
FIG. 6 is a flowchart describing a vertical or horizontal polarization receiving method using a 3-port orthogonal mode transducer in accordance with an embodiment of the present invention.

FIG. 6 is a flowchart describing a vertical or horizontal polarization receiving method using a 3-port orthogonal mode transducer in accordance with an embodiment of the present invention.

In step S601, a K-band (20 GHz) vertical or horizontal signal transmitted from a satellite is received from a satellite as two ±45 degree signals by using the 3-port orthogonal mode transducer 51.

In step S602, the received +45 degree vertical or horizontal polarization signal and the −45 degree vertical or horizontal polarization signal are synthesized to output a final vertical or horizontal polarization signal.

In addition, the vertical or horizontal polarization receiving method using the 3-port orthogonal mode transducer in accordance with an embodiment of the present invention further includes the following steps to install the 3-port orthogonal mode transducer 51 at an optimal location.

The received ±45 degree vertical or horizontal polarization signals are branched.

Thereafter, two branched analog vertical or horizontal polarization signals are converted into digital vertical or horizontal polarization signals, respectively.

Thereafter, intensities of the two converted signals are compared, and then rotation information of the 3-port orthogonal mode transducer according to a comparison result is output.

In accordance with an embodiment of the present invention, a K-band (20 GHz) vertical or horizontal signal transmitted from a satellite is received as two ±45 degree signals through the 3-port orthogonal mode transducer. The 3-port orthogonal mode transducer is rotated such that the intensities of the received two signals become the same, thereby searching an optimal location. The two received signals are synthesized to output a synthesized signal, so that an optimal satellite signal can be received at an optimal location.

The technology of the present invention described above can be realized as a program and stored in a computer-readable recording medium, such as CD-ROM, RAM, ROM, floppy disk, hard disk and magneto-optical disk. Since the process can be easily implemented by those skilled in the art of the present invention, further description will not be provided herein.

While the present invention has been described with respect to the specific embodiments, it will be apparent to those skilled in the art that various changes and modifications may be made without departing from the spirit and scope of the invention as defined in the following claims.

What is claimed is:

1. A vertical or horizontal polarization receiver using a 3-port orthogonal mode transducer, comprising:

the 3-port orthogonal mode transducer configured to receive a K-band (20 GHz) vertical or horizontal signal transmitted from a satellite as two ±45 degree signals;

a signal synthesizer configured to synthesize the +45 degree vertical or horizontal polarization signal and the −45 degree vertical or horizontal polarization signal received in the 3-port orthogonal mode transducer and output a final vertical or horizontal polarization signal;

a first branch unit configured to branch the +45 degree vertical or horizontal polarization signal received in the 3-port orthogonal mode transducer;

a second branch unit configured to branch the −45 degree vertical or horizontal polarization signal received in the 3-port orthogonal mode transducer;

an analog/digital converter configured to convert the analog vertical or horizontal signals respectively branched by the first branch unit and the second branch unit into digital vertical or horizontal polarization signals; and a controller configured to compare intensities of the digital vertical or horizontal polarization signals and output rotation information of the 3-port orthogonal mode transducer according to a comparison result.

2. The receiver of claim 1, wherein the 3-port orthogonal mode transducer includes:

a transmission port having a rectangular shape;

a first reception port having a rectangular shape inclined at about +45 degrees at a location being at about +45 degrees with respect to the transmission port; and a second reception port having a rectangular shape inclined at about −·degrees at a location being at about −45 degrees with respect to the transmission port, so that the 3-port orthogonal mode transducer receives K-band (20 GHz) vertical or horizontal polarization signals phase-delayed ±45 degrees.

3. The receiver of claim 2, wherein the controller outputs the rotation information for rotating the 3-port orthogonal mode transducer clockwise if an intensity of the K-band vertical or horizontal polarization signal phase delayed +45 degrees received via the first reception port is greater than an intensity of the K-band vertical or horizontal polarization signal phase-delayed −45 degrees received via the second reception port, and outputs the rotation information for rotating the 3-port orthogonal mode transducer counterclockwise if the intensity of the K-band vertical or horizontal polarization signal phase delayed +45 degrees received via the first reception port is not greater than the intensity of the K-band vertical or horizontal polarization signal phase-delayed −45 degrees received via the second reception port.

4. The receiver of claim 1, wherein each of the first branch unit and the second branch unit branches a respective one of the +45 degree and −45 degree signals received in the 3-port orthogonal mode transducer to 20 dB to 40 dB.

5. The receiver of claim 4, further comprising:

a driving unit configured to rotate the 3-port orthogonal mode transducer about a polarization axis, where after comparing the intensities of the digital vertical or horizontal polarization signals, the controller controls the driver unit to rotate the 3-port orthogonal mode transducer according to the rotation information.

6. A vertical or horizontal polarization receiving method using a 3-port orthogonal mode transducer, comprising the steps of:

receiving a K-band (20 GHz) vertical or horizontal signal transmitted from a satellite as two ±45 degree signals by using the 3-port orthogonal mode transducer;

synthesizing the received +45 degree vertical or horizontal polarization signal and the received −45 degree vertical or horizontal polarization signal to output a final vertical or horizontal polarization signal;

branching the received +45 degree vertical or horizontal polarization signals;

converting the branched two analog vertical or horizontal polarization signals into digital vertical or horizontal polarization signals; and comparing intensities of the digital vertical or horizontal polarization signals and outputting rotation information of the 3-port orthogonal mode converter according to a comparison result.

7. The method of claim 6, wherein the step of outputting the rotation information includes the steps of:

outputting the rotation information for rotating the 3-port orthogonal mode transducer clockwise if the intensity of the received +45 degree vertical or horizontal polarization signal is greater than an intensity of the received −45 degree vertical or horizontal polarization signal; and outputting the rotation information for rotating the 3-port orthogonal mode transducer counterclockwise if the intensity of the received −45 degree vertical or horizontal polarization signal is not greater than the intensity of the received −45 degree vertical or horizontal polarization signal.

8. The method of claim 6, further comprising the step of:

rotating the 3-port orthogonal mode transducer about a polarization axis according to the rotation information after the step of comparing the intensities of the digital vertical or horizontal polarization signals.

* * * * *